US006082434A

United States Patent [19]

Lam

[11] Patent Number: 6,082,434

[45] Date of Patent: Jul. 4, 2000

[54] SUPPORT FOR HANGING CROCHETED PIECES

[75] Inventor: Poon Chung Lam, Hillsborough, Calif.

[73] Assignee: L. Kee Co., Inc., South San Francisco, Calif.

[21] Appl. No.: 09/166,276

[22] Filed: Oct. 5, 1998

[51] Int. Cl.[7] ..... A47H 23/04

[52] U.S. Cl. ..... 160/330

[58] Field of Search ..... 160/330, 327, 160/354, 368.1, DIG. 7, 123, 124, 84.01

[56] References Cited

U.S. PATENT DOCUMENTS

| | | | |
|---|---|---|---|
| 1,054,233 | 2/1913 | Mueller . | |
| 1,589,123 | 6/1926 | Daudy | 160/330 |
| 2,006,465 | 7/1935 | Lieberknecht . | |
| 2,116,339 | 5/1938 | Carter | 160/330 |
| 2,123,413 | 7/1938 | Geller | 160/330 X |
| 2,352,531 | 6/1944 | Gallo | 160/330 |
| 2,365,500 | 12/1944 | Topliss | 160/330 |
| 2,558,974 | 7/1951 | Mecklenburger . | |
| 3,010,114 | 11/1961 | Lipschultz . | |
| 3,063,452 | 11/1962 | Del Guercio . | |
| 3,160,202 | 12/1964 | Rosen | 160/84.01 X |
| 3,439,725 | 4/1969 | Haimovitz et al. | 160/84.01 |
| 3,952,788 | 4/1976 | Scholer | 160/84.01 |
| 3,999,590 | 12/1976 | Koch | 160/84.01 |
| 4,133,191 | 1/1979 | Blore . | |
| 4,632,863 | 12/1986 | Henningsson | 428/225 |
| 4,928,743 | 5/1990 | Wojtysiak | 160/330 X |
| 4,956,218 | 9/1990 | Haining . | |
| 5,191,922 | 3/1993 | Wade | 160/330 X |
| 5,688,579 | 11/1997 | Konsti . | |
| 5,738,159 | 4/1998 | O'Brien | 160/124 X |

*Primary Examiner*—David M. Purol
*Attorney, Agent, or Firm*—Henry G. Kohlmann

[57] ABSTRACT

In hanging support for displays, curtains and the like which are made from crocheted material, a plurality of generally inelastic support structures are attached to said crocheted material and spaced apart so as to prevent sagging. The support structures include at least one generally inelastic upper member attached to the crocheted piece across the upper of the piece, and at least one generally inelastic vertical support member attached to the crocheted piece transverse of the upper member and disposed along its length. The upper member and the vertical member are each attached to a curtain rod member which holds the support structure together as an integral piece. The support structure may be made of cloth, plastic, canvas or similar materials which while somewhat elastic resist sagging or stretching. When a crocheted piece with the support structure attached thereto is placed on a curtain rod and hung in place the resistance to stretching or sagging which is a property of the support structure will be imparted to the crocheted piece which will generally remain in place.

15 Claims, 3 Drawing Sheets

SUPPORT FOR HANGING CROCHETED PIECES

BACKGROUND OF THE INVENTION

1. Field of the Invention

This invention relates to the hanging of drapery material. More specifically this invention relates to the hanging of crochet material for displays and the like.

2. Related Art

The related art is typified by the following:

U.S. Pat. No. 1,054,233 to Mueller recites a trim for knit garments. The trim is attached to the knit garment in order to provide support for buttons and buttonholes and the like. The trim receives the knit garment in a pocket which encloses the knit garment and is attached thereto. It is not intended to nor does it provide support for the knit garment. U.S. Pat. No. 2,006,465 entitled "Knitted Fabric and Method of Knitting the Same" to Lierberknecht teaches a manner of joining seams on knitted fabrics such as nylon stockings. The purpose of the welt in the Lierberknecht patent is to provide support for the joint seams and to prevent U.S. Pat. No. 4,133,191 to Blore entitled "Knitted Fabric Having Open Areas" describes a means for knitting a plurality of body yarns which are interspersed at intervals with locking yarns which has a lower melting temperature. The application of heat causes some unraveling to a specified point thereby creating a unique design. Again, this does not describe any supporting mechanisms for yarn. U.S. Pat. No. 4,956,218 to Haining is entitled "Fire Protection Blanket." It describes a fire protection blanket comprised of a flexible layer blanket having two layers of fire resistant material sandwiched by a insulating layer. There are handling straps which are arrayed on at lest one surface in a tic-tac-toe pattern and secured in several places along the straps to provide a plurality of grasping loops. The grasping loops are meant to provide support for the blanket when they are grasped, however, the blanket is not made of a knit material and it has an entirely different purpose. U.S. Pat. No. 5,688,579 to Konsti is entitled "Mounting Composite." This mounting composite permits the mounting of sheet materials of woven or knitted fabrics to be mounted on a support layer with means along its front surface for retaining and displaying the sheet material. This patent, although it discusses backing and support means, it addresses a mounting composite which permits the moveable mounting of sheet material such as notes, signs, pads or other kinds of things onto a wall that has a knit cloth or a knit surface through the use of hook-like projections. The mounting composite is removably attached to a vertical wall covered with woven or knitted fabric by engagement of the hook-like projections or other aspects of the mounting composite. This does not provide support for the knit fabric, but is rather is a device used for hanging notes and other materials onto the knit fabric.

While linings and backings for other materials, such as for curtains and the like, has been known these are usually only attached at the peripheral ends and prevent the view through the piece which is the attractive nature of crocheted pieces. The related art does not disclose any system for the support of knit or crocheted fabrics to prevent sagging as provided by instant invention.

BRIEF DESCRIPTION OF THE INVENTION

The instant invention provides a hanging support for displays, curtains and the like which are made from crocheted material. The support structure members are spaced so as to prevent sagging but permit a view through the material which would be enjoyed if the piece were placed on a table or other surface. The support structure includes at least one generally inelastic upper member attached to the crocheted piece across the top of the piece, and at least one generally inelastic vertical support member attached to the crocheted piece transverse of the upper member and disposed along its length. The upper member and each vertical support member are each attached to a joining curtain rod member which is disposed parallel to the upper member to hold the various members in position. These support members may be made of cloth, plastic, canvas or similar materials which while somewhat elastic resist sagging.

When a crocheted piece with the support structure attached thereto is placed on a curtain rod and hung in place the resistance to stretching or sagging which is a property of the support structure will be imparted to the crocheted piece which will generally remain in place.

Multiple horizontal members may be used to form an open box or lattice for supporting the crocheted piece and still allow a view through the crocheted piece. The crocheted piece itself may be designed to obscure the support member by having a plurality of tight crocheted designs placed along the length of each support member.

DETAILED DESCRIPTION OF THE PREFERRED EMBODIMENT

Crocheted pieces are generally not suitable for hanging due to the size and weight of the crocheted yarn. If a crocheted piece is mounted to a curtain rod the weight of the crocheted piece will cause sagging and stretching in areas throughout the crocheted piece dependent on the nature of the design and the amount of material present at each vertical increment along the piece. Accordingly, the instant invention provides a support which will prevent sagging of crocheted material, facilitate the use of the same as a hanging panel for curtains, while still permitting the view of through the crocheted piece which reveals the beauty of the design.

Figure 1:
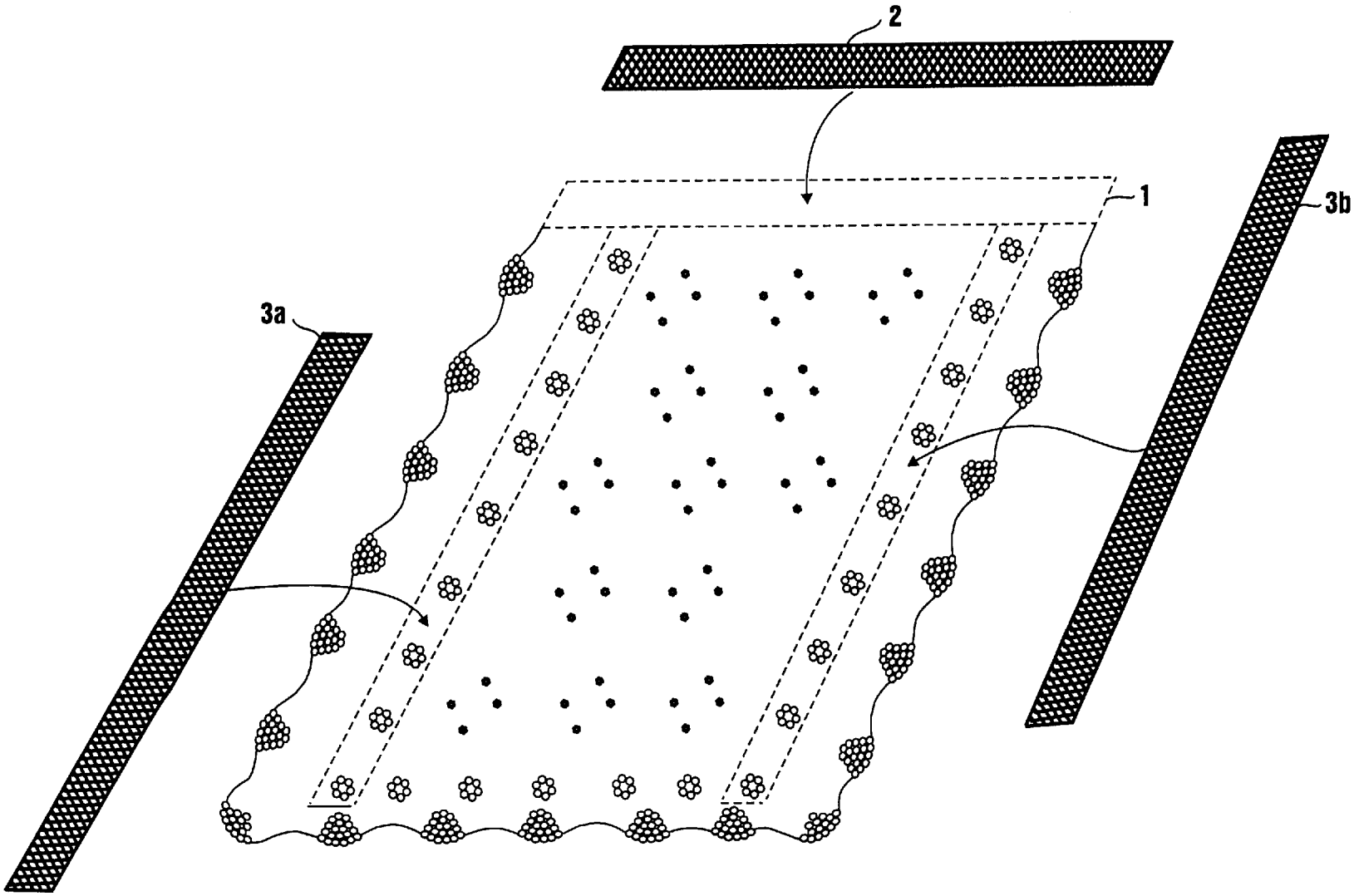
FIG. 1 is a prospective view of the crocheted piece with a support structure attached.
Figure 2:
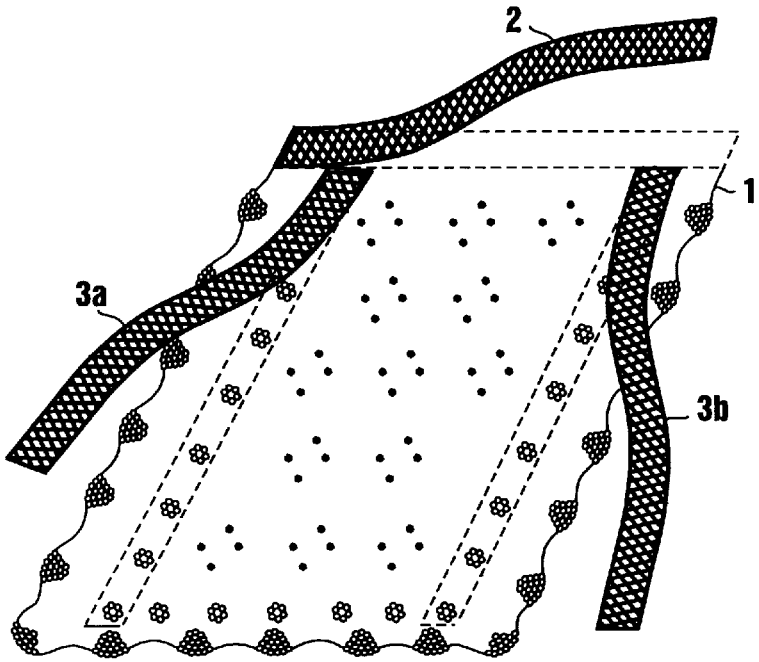
FIG. 2 is an exploded view, schematic of the piece shown from the rear indicating placement of the support structure.
Figure 3:
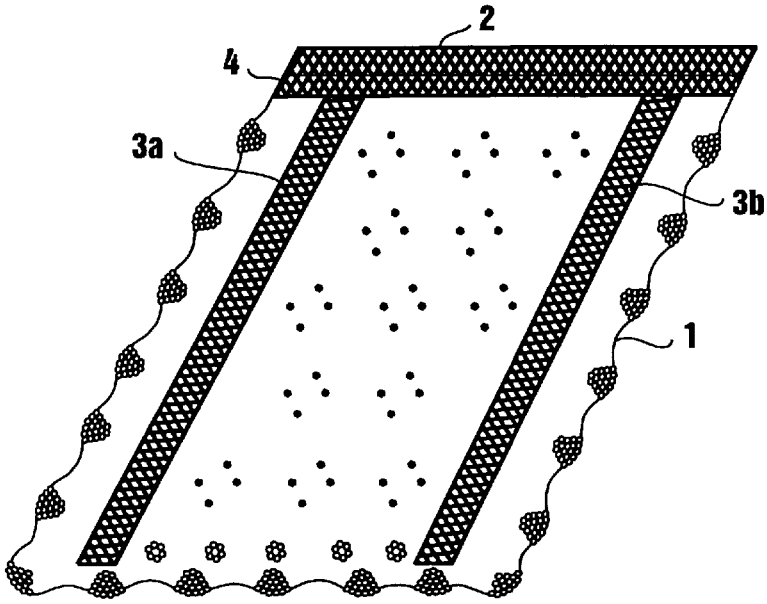
FIG. 3 is a view of the crocheted piece with the support structure being attached thereto.
Figure 4:
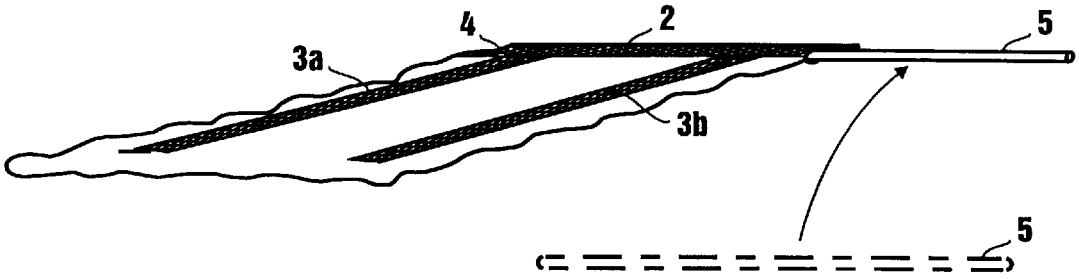
FIG. 4 is a schematic of the crocheted piece with the support structure attached showing additional support strip.
Figure 5:
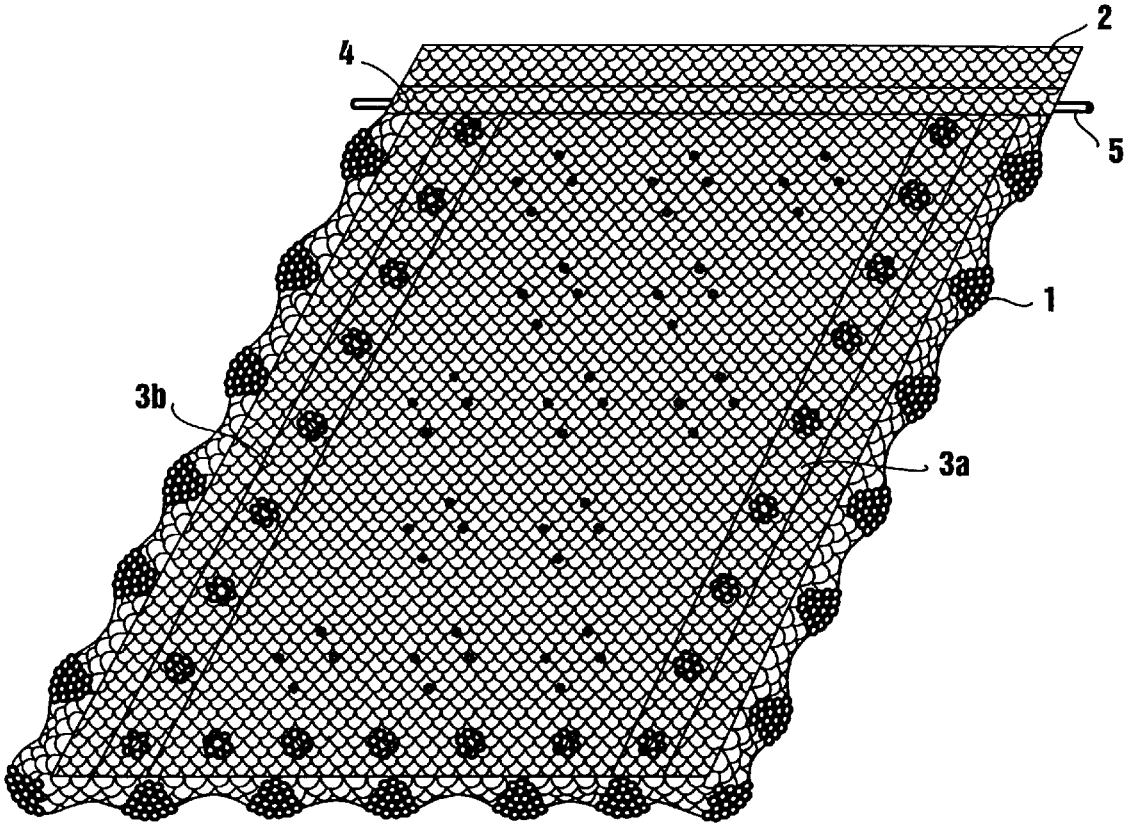
FIG. 5 is a prospective view of the crocheted work and a curtain rod which is inserted into the crocheted support structure hangers.

FIG. 1 shows a schematic of a crocheted piece 1 having an upper or horizontal support structure 2 which is an elongated panel of generally inelastic material such as silk, canvas, plastic or combinations thereof or other material or combinations thereof which resists stretching. Side support panels 3*a* and 3*b* are mounted along the sides of the crocheted piece and disposed in a position spaced apart from the edges of the crocheted piece. These side panels are also made of a generally inelastic material and may be made of the same materials as used with the upper panel 2. The side or vertical panel 3*a* and 3*b* support structures are positioned immediately below the upper support structure. FIG. 2 shows the precise placement of the upper support structure 2 and the side panels 3*a* and 3*b* as they are being attached to the crocheted piece. The side panel structures may be placed over a particular design feature on the crocheted piece to make it appear that these particular structures are part of the overall piece. FIG. 3 shows the addition of the curtain rod sleeve 4 generally made of the same material as the upper panel 2 and side support panels 3*a* and 3*b*. The curtain rod sleeve 4 is attached to both the upper panel 2 and the two side panels 3*a* and 3*b*. Attachment of the various support structures and the curtain rod sleeve 4 may be accomplished by stitching the various support structures to the crocheted piece by hand, by machine or by gluing the same into place or otherwise attaching the panels. The attachment of the curtain rod sleeve 4 to the upper structure 2 and to the side pieces 3*a* and 3*b* forms an integrated structure which provides a broad band of support to the upper portion of the crocheted piece and supports the upper end of the two side support 3*a* and 3*b* and holds them in place. In return the side panels 3*a* and 3*b* provide a an elongated support structure which prevents the crocheted piece from sagging about the sides of each of the support pieces 3*a* and 3*b*. The placement of support panels 3*a* and 3*b* will vary depending on the length of the crocheted piece 1 that needs to be supported and the thickness and weight of the yarn used to fabricate the crocheted piece. The upper panel 2 could be provided with a loop or flap of material for receipt of a curtain rod 5 as shown in FIG. 4 and be attached to the side panels 3*a* and 3*b* and still function as intended. However, the preferred embodiment includes the curtain rod sleeve 4 which provides additional strength and durability. FIG. 4 shows the piece 1 at the support panels 2, 3*a*, 3*b* and the curtain rod sleeve 4 with a curtain rod 5 being inserted therein. FIG. 5 shows the prospective view of the completed piece 1 and the support panels 2, 3*a*, 3*b* and 4 with the curtain rod 5 fully inserted therein ready for hanging.

It will be clear to those skilled in the art that there are other embodiments for which this invention may be implemented and it is intended that they be included within the scope of the aforementioned invention.

Having thus described the invention what is claimed is:

1. A support structure including a fabric piece to be supported, said support structure having an upper end comprising:

a. a fabric piece susceptible to stretching;

b. at least one elongated horizontal member disposed along the upper end of said fabric piece and attached thereto;

c. a plurality of vertical members, resistant to stretching, spaced apart a selected distance dependent upon the weight of said fabric piece to minimize sagging adjacent said horizontal member and attached to said fabric piece such that a greater portion of said elongated vertical member is disposed below said horizontal member than above said horizontal member, d. a loop of material forming a tube for receiving a curtain rod, said tube attached to said fabric piece at said upper end of said fabric piece.

2. A support structure as described in claim 1 wherein said loop of material is attached to said elongated horizontal member and said at least one elongated vertical member.

3. A support structure as described in claim 1 wherein said fabric piece is a crocheted piece and said members are attached by stitching of said members to said crocheted piece.

4. A support structure as described in claim 1 wherein said vertical members are spaced apart from at least one side of said fabric piece.

5. A support structure including a crocheted piece to be supported, said support structure having an upper end comprising:

a. a crocheted piece susceptible to stretching;

b. at least one elongated horizontal member disposed along the upper end of said crocheted piece and attached thereto; and c. a plurality of vertical members, resistant to stretching, spaced apart a selected distance dependent upon the weight of said fabric piece to minimize sagging adjacent said horizontal member and attached to said crocheted piece such that a greater portion of said elongated vertical member is disposed below said horizontal member than above said horizontal member.

6. A support structure as described in claim 5 wherein there are a plurality of elongated horizontal members at least one of which is adapted for receiving a hanging apparatus for hanging said crocheted piece and at least one other of said plurality of horizontal members is spaced apart from one side of said crocheted piece.

7. A support structure as described in claim 6 wherein said members are attached by stitching of said members to said crocheted piece.

8. A support structure as described in claim 7 wherein there are a plurality of vertical members, spaced apart a selected distance dependent upon the weight of said crocheted piece.

9. A support structure as described in claim 8 wherein said vertical members are spaced apart from at least one side of said crocheted piece.

10. A support structure as described in claim 9 wherein said horizontal members are spaced apart from at least one side of said crocheted piece.

11. A support structure including a fabric piece to be supported, said support structure and said fabric piece comprising:

a. a fabric piece susceptible to stretching;

b. at least one elongated first horizontal member disposed along the upper end of said fabric piece and attached thereto;

c. a plurality of vertical members, spaced apart a selected distance dependent upon the weight of said fabric piece to minimize sagging adjacent said first horizontal member and attached to said crocheted piece such that a greater portion of said elongated vertical member is disposed below said first horizontal member than above said first horizontal member, and d. a loop of materials forming a tube for receiving a hanging apparatus attached to said fabric piece at said upper end of said piece and further attached to said first horizontal member and to said vertical member to form an integral piece.

12. A support structure as described in claim 11 wherein there are a plurality of elongated first horizontal members at least one of which is adapted for receiving a hanging apparatus for hanging said fabric piece.

13. A support structure as described in claim 12 wherein at least one second elongated horizontal member is attached to said fabric piece at an end opposite said first horizontal member attached at said upper end of said fabric piece.

14. A support structure as described in claim 13 wherein all of said members are attached by stitching of said members to said fabric piece.

15. A support structure as described in claim 14 wherein said horizontal members and said vertical members are each spaced apart from at least one side of said fabric piece.

* * * * *